US005564444A

United States Patent [19]

Naylor

[11] Patent Number: 5,564,444

[45] Date of Patent: Oct. 15, 1996

[54] PROCESSING TOBACCO LEAF STEM

[75] Inventor: Donald B. Naylor, Southampton, England

[73] Assignee: British-American Tobacco Company Limited, Middlesex, England

[21] Appl. No.: 958,000

[22] Filed: Oct. 8, 1992

[30] Foreign Application Priority Data

Oct. 23, 1991 [GB] United Kingdom ..... 9122476

[51] Int. Cl.[6] ..... A24B 3/18

[52] U.S. Cl. ..... 131/290; 131/312; 131/313; 131/364

[58] Field of Search ..... 131/290, 311, 131/312, 313, 360, 364

[56] References Cited

U.S. PATENT DOCUMENTS 3,204,641 9/1965 Jones ..... 131/140
3,219,042 11/1965 Molins ..... 131/312
4,566,470 1/1986 Brackmann ..... 131/312

FOREIGN PATENT DOCUMENTS 419188 3/1991 European Pat. Off. .
2078085 1/1982 United Kingdom .

*Primary Examiner*—William H. Grieb
*Attorney, Agent, or Firm*—Kane, Dalsimer, Sullivan, Kurucz, Levy, Eisele and Richard

[57] ABSTRACT

Tobacco leaf stem is separated into large-stem and small-stem fractions, the large-stem fraction is cut in a stem cutter and the small-stem fraction is shredded in a mill, whereafter the cut and shredded materials are mixed.

7 Claims, 1 Drawing Sheet

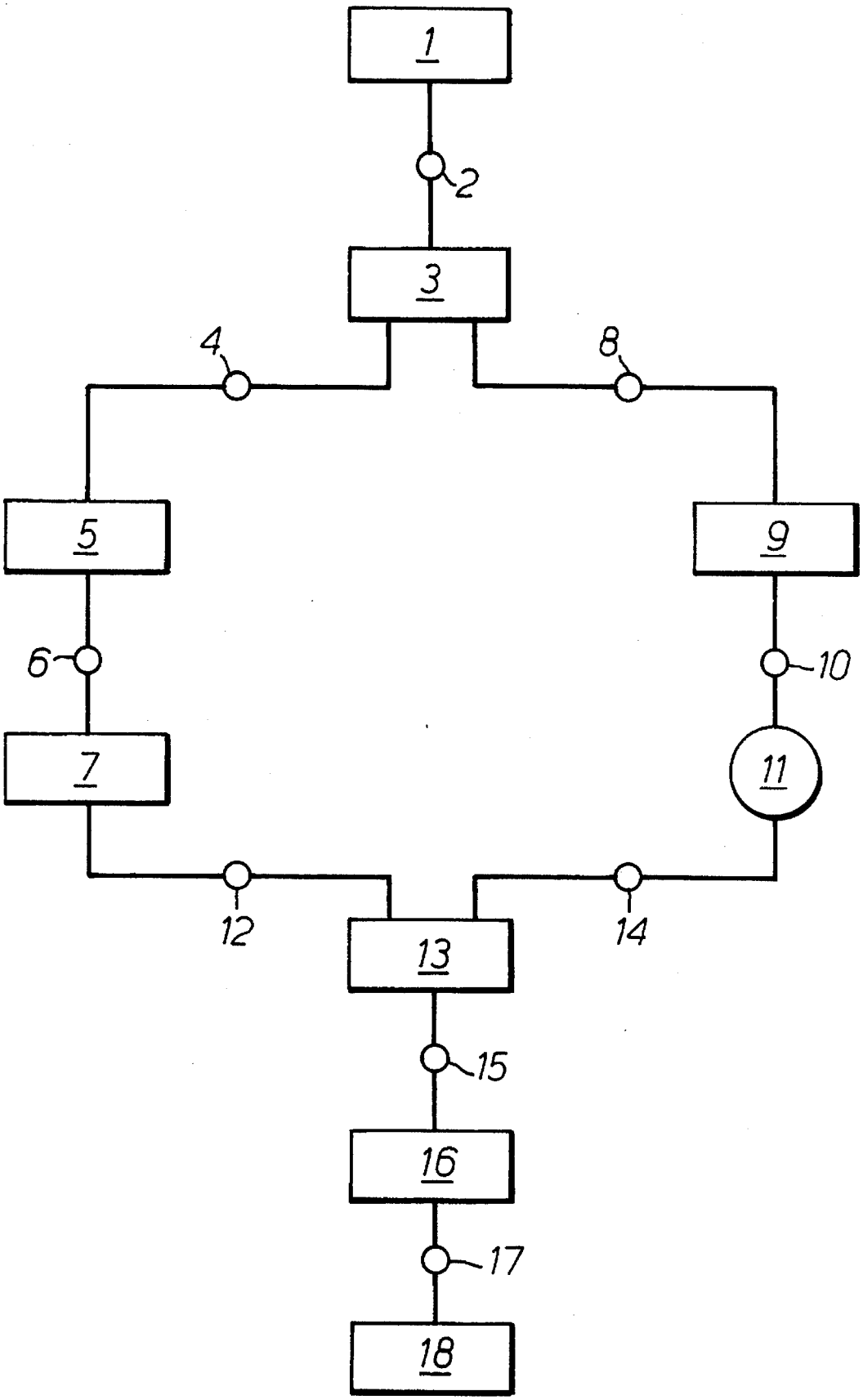
1
2
3
4
8
5
9
6
10
7
11
12
14
13
15
16
17
18

PROCESSING TOBACCO LEAF STEM

BACKGROUND OF THE INVENTION

1. Field of the Invention

The subject invention relates to the processing of tobacco leaf stem.

2. Brief Description of Related Art

An initial step in processing tobacco leaves to provide cigarette filler material is the threshing of the leaves to separate the stem and lamina portions of the leaves. Thereafter the stem and lamina are processed separately in so-called stem and lamina lines. The product of the stem line (cut rolled stem—CRS) is then mixed with the product of the lamina line (cut lamina) to provide cigarette filler material.

The stem cutter in the stem line comprises means for forming a compressed so-called cheese of rolled stem and for feeding the cheese to moving cutter blades. Whole stem fed to the stem cutter includes small stem pieces which account for a not inconsiderable proportion of the whole stem. These small stem pieces tend to be removed from the cheese by the cutter blades rather than being cut by the blades. This defect in the operation of the cutter results in a less than homogeneous product. For this reason the product is classified and the uncut stem pieces are recycled to the stem cutter.

It is an object of the subject invention to provide for an improved processing of tobacco leaf stem. It is also an object of the subject invention to provide for improved operation of a stem cutter.

SUMMARY OF THE INVENTION

From the specification of U.S. Pat. No. 3,204,641 and from United Kingdom Patent Publication No. 2 078 085 it is known to shred whole stem in a disc mill and from European Patent Publication No. 419 188 it is known to feed whole tobacco leaf to a disc mill.

The subject invention provides a tobacco leaf stem processing line comprising stem separation means operable to separate larger and smaller stem pieces, a cutter operable to cut stem, a mill operable to mill stem to provide a shredded stem product, first conveying means operable to convey stem to said separation means, second conveying means operable to convey a large-stem fraction from said separation means to said cutter and third conveying means operable to convey a small-stem fraction from said separation means to said mill.

The subject invention also provides a method of processing tobacco leaf stem wherein whole stem is separated to provide a large-stem fraction and a small-stem fraction, the large-stem fraction is cut in a stem cutter and the small-stem fraction is shredded in a mill.

The subject invention further provides a cigarette filler material comprising, in admixture, cut lamina, cut stem and shredded stem, the cut stem having been produced from larger stem pieces and the shredded stem having been produced from smaller seem pieces.

BRIEF DESCRIPTION OF THE DRAWING

The drawing depicts a tobacco factory stem processing line.

DETAILED DESCRIPTION OF THE INVENTION

The stem processing line preferably comprises mixing means operable to mix cut stem from the cutter and shredded stem from the mill. Suitably, the stem processing line comprises means operable to dry the cut stem and the shredded stem, such drying means being operable to dry separately cut stem and shredded stem or to dry a mixture thereof. Advantageously the drying means serves also to perform the just mentioned mixing. It is advantageous for the stem processing line to comprise classifying means operable to remove from cut and shredded stem unwanted size fractions, dust fractions for example. The classifying means may be operable to classify separately cut stem and shredded stem or to classify a mixture thereof.

Suitably, the separation means is a sieve which is purpose built for stem sieving. Such sieves are well known to those skilled in the art.

The smaller stem fraction fed to the mill may be augmented by small stem from a source extraneous of the whole stem fed to the stem separation means.

The cut stem may be subjected to an expansion process, suitably a water treatment expansion process.

Suitably, the stem separation means is operable to separate a small-stem fraction which accounts for 10–30% by weight of the whole stem, more suitably 15–25% by weight.

The mill used to provide the shredded stem product is suitably a disc mill. Disc mills appropriate for carrying out the subject invention are manufactured by, for example, Sprout-Bauer. The mills may be fitted with one rotary and one static disc or, more preferably, with two counter rotating discs.

The stem cutter is suitably a cutter conventional in a tobacco factory stem line.

In order that the subject invention may be clearly understood and readily carried into effect, reference will now be made, by way of example, to the accompanying drawing, which drawing diagrammatically depicts a tobacco factory stem line.

In operation of the stem line whole stem is conditioned in a conditioner 1 to a moisture content of 35% and is then conveyed by a conveyer 2 to a sieve 3 (which provides stem separator means). The sieve 3 is suitably a two stage sieve comprising a one inch (25.0 mm) chevron sieve element below which is positioned a ½ inch (12.5 mm) chevron sieve element. Such sieve 3 provides a large-stem fraction which is carried over both of the sieve elements and a small-stem fraction which passes through the ½ inch sieve element.

The large-stem fraction is conveyed by a conveyer 4 to a stem cutter 5. The cut stem which issues from the cutter 5 is conveyed by a conveyer 6 to a water treatment expansion unit 7.

The small-stem fraction from the sieve 3 is conveyed by a conveyer 8 to a conditioner 9, in which the moisture content of the smaller stem fraction is raised to 45%. The small-stem fraction is then conveyed by a conveyer 10 to a mill 11. The mill 11 is suitably a Sprout-Bauer Model 415–24 fitted with counter rotating plates having Sprout-Bauer designations 325 and 326.

The expanded cut stem from expansion unit 7 is conveyed by a conveyer 12 to a dryer 13, a Hambro fluid bed dryer for example, and the shredded stem from the mill 11 is conveyed to the dryer 13 by a conveyer 14. In the dryer 13 the stem is dried so that upon issuing from the dryer 13 the moisture content of the stem mixture is 15%. The stem mixture is next conveyed to a classifier 16 by a conveyer 15. In the classifier 16 any particles of over-sized dimensions are removed and the cut and shredded stem portions are subjected to further and thorough mixing. The stem mixture is then conveyed by a conveyer 17 to a blending bin 18 in which the stem mixture is blended with cut lamina from a lamina line (not shown).

By use of the subject invention in place of the conventional stem line producing water treatment expanded CRS, the efficiency of operation of the stem cutter is improved. Furthermore, it has been noted that cigarettes containing, as the stem proportion of the filler, stem processed in accordance with the subject invention, exhibit lower mainstream smoke carbon dioxide deliveries, and often lower pressure drops, than control cigarettes containing as the stem proportion of the filler conventional water treatment expanded CRS. The filling value of stem processed according to the subject invention is equal to or greater than that of comparable conventional water treatment expanded CRS.

I claim:

1. A method of processing tobacco leaf stem wherein whole stem is separated to provide a large-stem fraction and a small-stem fraction, the large-stem fraction is cut in a stem cutter and the small-stem fraction is shredded in a mill.

2. A method according to claim 1, wherein the small-stem fraction accounts for 10% to 30% by weight of the whole stem.

3. A method according to claim 2, wherein the small-stem fraction accounts for 15% to 25% by weight of the whole stem.

4. A method according to claim 1, wherein cut stem from the cutter and shredded stem from the mill are mixed.

5. A tobacco leaf stem processing line comprising stem separation means operable to separate larger and smaller stem pieces, a cutter operable to cut stem, a mill operable to mill stem to provide a shredded stem product, first conveying means operable to convey stem to said separation means, second conveying means operable to convey a large-stem fraction from said separation means to said cutter and third conveying means operable to convey a small-stem fraction from said separation means to said mill.

6. A stem processing line according to claim 5, in which said mill is a disc mill.

7. A cigarette filler material comprising, in admixture, cut lamina, cut stem and shredded stem, the cut stem having been produced from larger stem pieces and the shredded stem having been produced from smaller stem pieces.

* * * * *